US006308339B1

(12) United States Patent
Murakami et al.

(10) Patent No.: US 6,308,339 B1
(45) Date of Patent: Oct. 30, 2001

(54) TRUNKS TYPE WEARING ARTICLE

(75) Inventors: Masaki Murakami; Michiyo Matsushita, both of Kagawa (JP)

(73) Assignee: Uni-Charm Corporation (JP)

( * ) Notice: Subject to any disclaimer, the term of this patent is extended or adjusted under 35 U.S.C. 154(b) by 0 days.

(21) Appl. No.: 09/601,941

(22) PCT Filed: Dec. 8, 1999

(86) PCT No.: PCT/JP99/00887

§ 371 Date: Sep. 25, 2000

§ 102(e) Date: Sep. 25, 2000

(87) PCT Pub. No.: WO00/33678

PCT Pub. Date: Jun. 15, 2000

(30) Foreign Application Priority Data

Dec. 9, 1998 (JP) ..... 10-350413

(51) Int. Cl.[7] ..... A41B 11/00

(52) U.S. Cl. ..... 2/400; 2/403; 2/406; 604/385.1; 604/378

(58) Field of Search ..... 2/79, 83, 228, 2/238, 114, 400–409, 78.1, 782, 69; 604/385.1, 385.2, 386–398

(56) References Cited

U.S. PATENT DOCUMENTS 4,205,679 * 6/1980 Repke et al. ..... 604/385.1
4,630,320 * 12/1986 Van Gompel ..... 2/406
4,698,855 * 10/1987 Hicks ..... 2/402
4,745,636 * 5/1988 Lunt ..... 2/402
4,883,481 * 11/1989 Blanchard ..... 604/385.1
5,340,424 * 8/1994 Matsushita ..... 2/401 X
5,440,764 * 8/1995 Matsushita ..... 2/401
5,864,890 * 2/1999 Niedermeyer ..... 2/403
6,092,242 * 7/2000 Niedermeyer ..... 2/400
6,240,563 * 6/2001 Niedermeyer ..... 2/114

FOREIGN PATENT DOCUMENTS 42-9056 5/1967 (JP) .
3038122 U 6/1997 (JP) .

OTHER PUBLICATIONS

Microfilm of Japanese Utility Model Application No. 104881/1990 (Laid–open No. 60501/1992) (Okui K.K.), May 25, 1992.

* cited by examiner

*Primary Examiner*—Gloria M. Hale
(74) *Attorney, Agent, or Firm*—Baker & Daniels

(57) ABSTRACT

A trunks-type garment has crotch region formed by two sheets that are superposed and bonded together. Extensions of these two sheets extending from a bottom of the crotch region of the garment are folded back onto the respective sheets of form lapels.

6 Claims, 5 Drawing Sheets

TRUNKS TYPE WEARING ARTICLE

FIELD OF THE INVENTION

This invention relates to a trunks-type garment and more particularly to such a garment suitable as disposable garment.

BACKGROUND ART

In many cases, a transition between front and rear bodies in a crotch region of a trunks-type garment has conventionally been formed by putting and bonding a pair of sheets flat together along a margin defining the transition. Particularly for such a disposable type garment, a nonwoven fabric or a plastic film has usually been used as stock material and bonding thereof has often been carried out by means of hot melt adhesive or sealing techniques.

The prior art has already taken account of the fact that the margin for bonding the sheets together should not be dimensioned to be excessively wide. Excessive wide margin for bonding would correspondingly increase an amount of the sheets to be used and, in addition, make the sheets liable to be frayed and/or locally tensioned. Consequently, such excessively wide margin for bonding would make it difficult to obtain a good tailored garment. If the sheets are put flat and bonded together along margins that are dimensioned to be sufficiently narrow, the sheets would have a rigidity along the margin for bonding that is substantially higher than a rigidity of the remaining portions. As a result, the margin for bonding may cause uncomfortable skin stimulation from which the garment wearer suffers. Nevertheless, reduction of the manufacturing cost is essential to the disposable garment and, to meet this requirement, the relatively simple manner of bonding has usually been adopted, i.e., the sheets have been put and bonded flat together.

SUMMARY OF THE INVENTION

It is an object of this invention to alleviate uncomfortable stimulation from which the wearer of a trunks-type garment has conventionally suffered due to the presence of a margin for bonding even when the sheets forming the garment are put and bonded flat together along the margin for bonding in order to form a transition between front and rear bodies of the garment in a crotch region.

The object set forth above is achieved, according to this invention, by a trunks-type garment including a pair of sheets having U-shaped cutouts which are identical to each other in shape as well as in size wherein the pair of sheets are put flat together so as to align said cutouts with each other and respective peripheries of the cutouts put flat are bonded together to form a transition from a front body to a rear body in a crotch region.

The trunks-type garment of the present invention includes the pair of sheets respectively have relatively long extensions which extend outward from edges of the U-shape cutouts at bottoms of respective the U-shaped cutouts and are folded back onto inner surfaces of the sheets forming respective said extensions.

According to one embodiment of this invention, the extensions are folded back so as to describe annular curves in the vicinity of their proximal ends and bonded to the inner surfaces of respective the sheets.

According to another embodiment of this invention, the pair of sheets are made of a nonwoven fabric containing thermoplastic synthetic fibers and bonded to each other along the edges of the cutouts by use of hot melt adhesive or sealing technique.

DESCRIPTION OF THE BEST MODE FOR CARRYING OUT THE INVENTION

Details of a trunks-type garment according to this invention will be more fully understood from the description of disposable trunks given hereunder as a specific embodiment of this invention with reference to the accompanying drawings.

Figure 1:
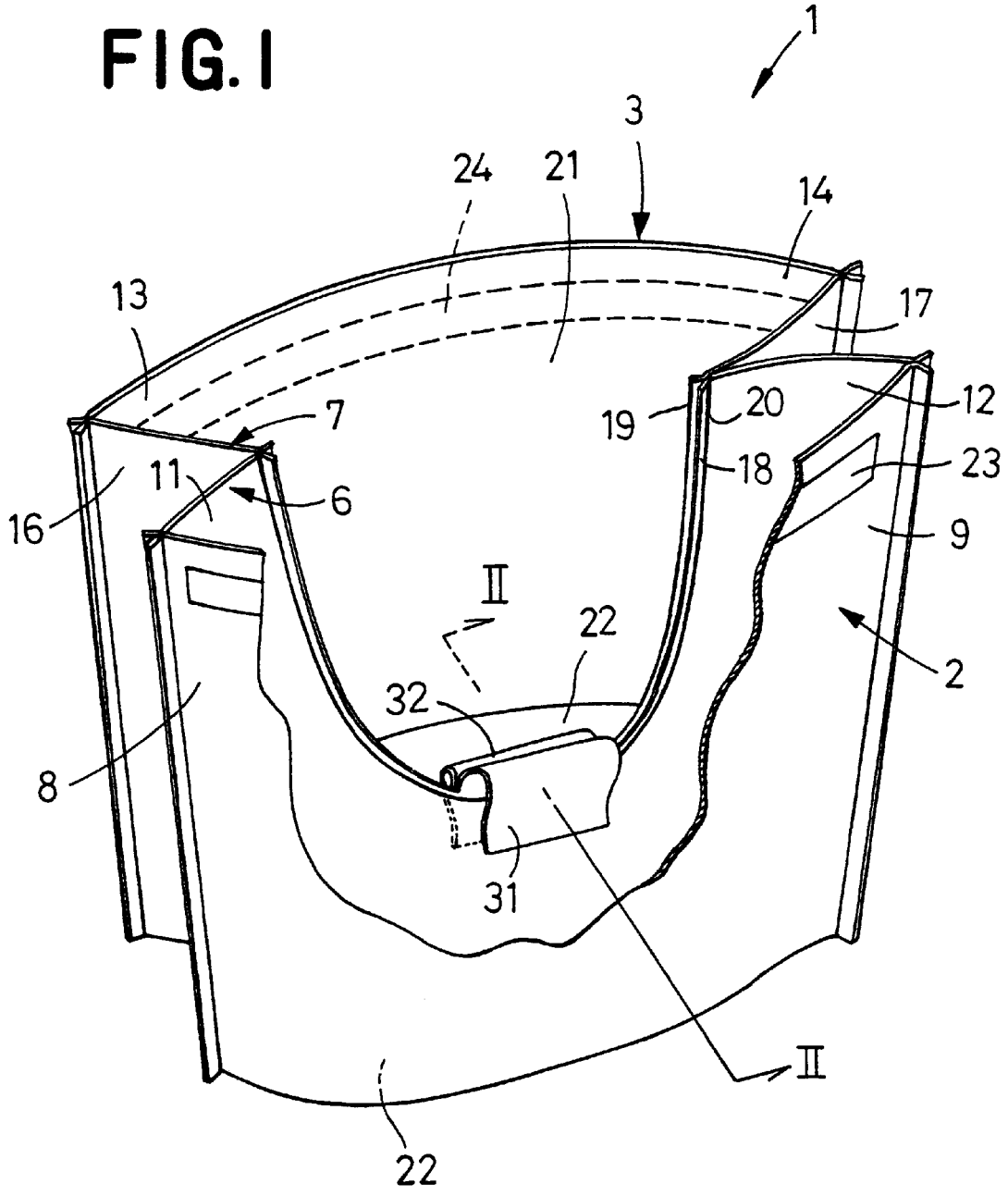
FIG. 1 is a perspective view showing a partially cutaway trunks-type garment according to one embodiment of this invention.

Disposable trunks 1 shown by FIG. 1 in a perspective view as partially broken away generally comprise left- and right-hand lateral bodies 2, 3 destined to cover left- and right-hand lateral regions of a wearer's torso, respectively, and left- and right-half middle bodies 6, 7 destined to cover front, rear and crotch regions of the wearer's torso. It should be understood here that the portion of the trunks 1 on the left-hand as viewed in FIG. 1 is destined to be placed in front of the wearer's torso. The left-hand lateral body 2 has front and rear side portions 8, 9 which are respectively bonded to front and rear side portions 11, 12 of the left-half middle body 6. Similarly, the right-hand lateral body 3 has front and rear side portions 13, 14 which are respectively bonded to front and rear side portions 16, 17 of the right-half middle body 7. The left- and right-half middle bodies 6, 7 are respectively formed in the crotch region of the trunks 1 with U-shaped cutouts 18, 19 defining transitions between the front and rear side portions of these middle bodies 6, 7. The left- and right-half middle bodies 6, 7 are bonded to each other along a sealing line 20 defined by edges of the cutouts 18, 19. The respective bodies 2, 3, 6, 7 are bonded one to another so as to form a waist-opening 21 and a pair of leg-openings 22, 22 of the trunks 1. The left- and right-hand lateral bodies 2, 3 are respectively provided along the associated edges of said waist-opening 21 with elastic members 23, 24 bonded with a tension to these bodies 2, 3 so that the trunks 1 may be elastically stretchable and contractible in its circumferential direction. Said cutouts 18, 19 of the left- and right-half middle bodies 6, 7 are provided along bottoms thereof with lapels-like portions 31, 32, respectively.

Figure 2:
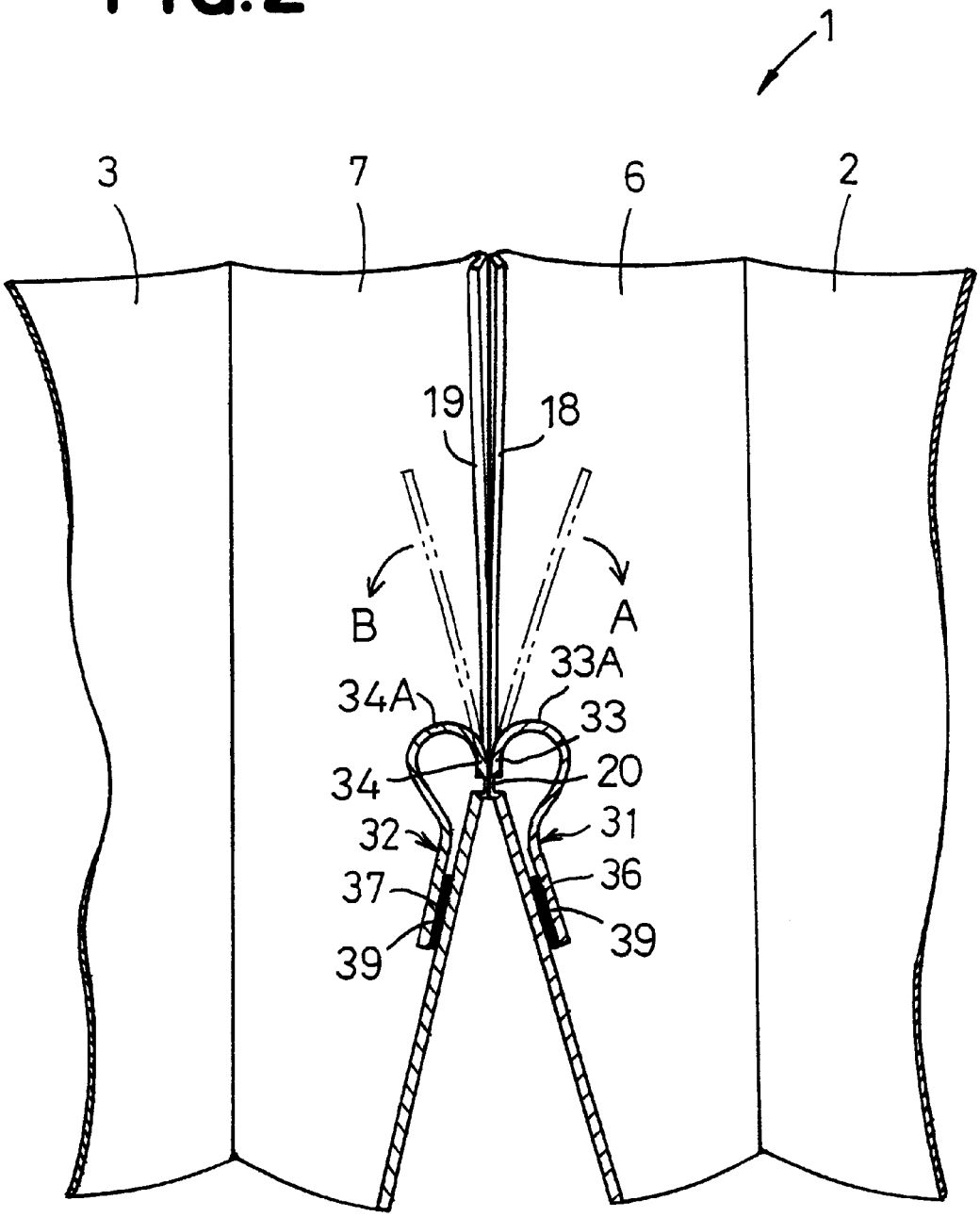
FIG. 2 is a fragmentary sectional view taken along a line II—II in FIG. 1.

FIG. 2 is a fragmentary sectional view taken along a line II—II in FIG. 1. The lapels-like portions 31, 32 of the left- and right-half middle bodies 6, 7 are respectively formed by folding portions thereof respectively extending upward as indicated by imaginary lines back in directions as indicated by arrows A and B, respectively. The lapels-like portions 31, 32 have their proximal ends 33, 34 defined by said bottoms of the respective cutouts 18, 19 and are folded back in the vicinity of said proximal ends 33, 34 so that said lapel-like portions 31, 32 present annular cross-sections as viewed transversely of the trunks 1. The lapels-like portions 31, 32 have their distal ends 36, 37, i.e., their lower ends bonded to the inner surfaces of the associated middle bodies 6, 7 by means of hot melt adhesive layers 39, 39. The uppermost points 33A, 34A on the annular cross-sections presented by the respective lapels-like portions 31, 32 lie at a level higher than a section of the sealing line 20 extending along the bottoms of the respective U-shaped cutouts 18, 19. With the middle bodies 6, 7 of such arrangement, there is no apprehension at least in the vicinity of the lapels-like portions 31, 32 that the sealing line 20 more or less rigidified by sealing treatment might uncomfortably stimulate the wearer's skin. A nonwoven fabric of crimped synthetic fibers may be used as stock material for the middle bodies 6, 7 to facilitate the lapels-like portions 31, 32 to be annularly deformed under a high elasticity characterizing such nonwoven fabric. The lapels-like portions 31, 32 elastically deformed in this manner can fit the wearer's crotch region without giving the wearer any feeling of incompatibility.

Figure 3:
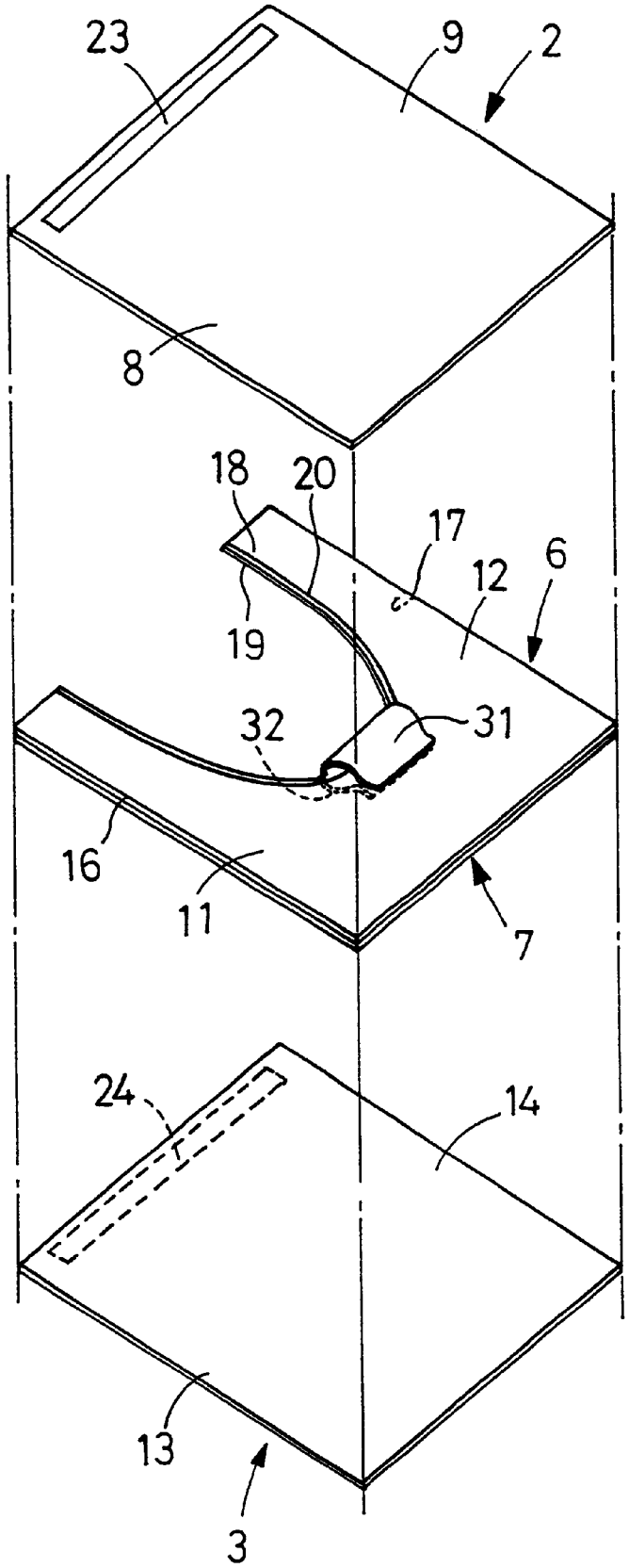
FIG. 3 is an exploded perspective view of the trunks type garment.
Figure 4:
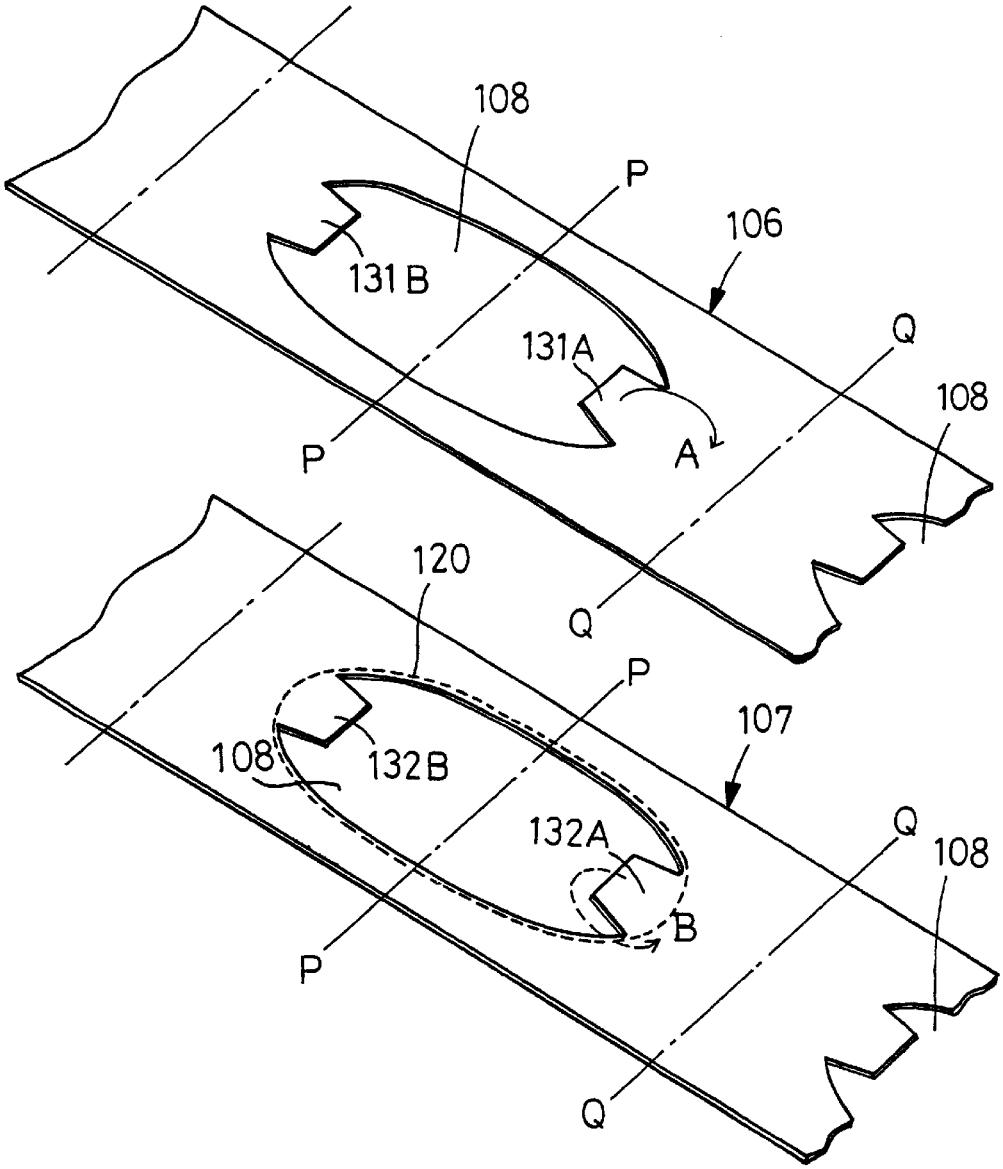
FIG. 4 is a diagram illustrating the steps of completing a middle body of the garment from left- and right half middle bodies.

FIG. 3 is an exploded perspective view of the trunks 1 and FIG. 4 is a diagram exemplarily illustrating the steps of assembling left- and right-half middle bodies into a complete middle body of the garment. In FIG. 3, the left- and right-hand lateral bodies 2, 3 are illustrated as being spaced from the middle bodies 6, 7 which have been bonded together along the sealing line 20 defined by the edges of the respective U-shaped cutouts 18, 19. FIG. 4 illustrates a unit section of continuously fed first sheet 106 destined to form the left-half middle body 6 lying above a unit section of continuously fed second sheet 107 destined to form the right-half middle body 7. The first and second sheets 106, 107 are substantially identical to each other and formed in the transversely middle with substantially oval through-holes 108, 108, respectively. At one of longitudinally opposite ends of each the oval through-hole 108, the first sheet 106 has an extension 131A destined to form the lapels-like portion 31 and the second sheet 107 correspondingly has an extension 132A destined to form the lapels-like portion 32. These extensions 131A, 132A inwardly protrude from the edges of the respective through-holes 108. Now the first and second sheets 106, 107 are placed one upon another with their through-holes 108 being in alignment and bonded together along a line 120 defined by a periphery of the through-hole 108 of the second sheet 107. Then the first and second sheets 106, 107 are cut along a line P—P dividing the through-hole 108 into left and right halves and along a line Q—Q dividing a section of the sheets 106, 107 defined between each pair of adjacent through-holes 108, 108 into left and right halves. Thereafter, the respective extensions 131A, 132A are folded back in directions as indicated by arrows A, B, followed by bonding these extensions 131A, 132A to the first and second sheets 106, 107, respectively, to obtain the assembled left- and right-half middle bodies 6, 7 as shown in FIG. 3.

In the course of making the trunks 1, the through-holes 108 are cut out from the first and second sheets 106, 107 with the extensions 131A, 132A remaining on the peripheries of the respective through-holes 108. In this manner, a loss of the stock material for the first and second sheets 106, 107 can be minimized, i.e., the stock material can be effectively utilized. The trunks 1 may be made in accordance with the procedure as has been described above to avoid an additional cost for stock material as well as labor which would be required if the lapels-like portions 31, 32 are provided separately of the first and second sheets 106, 107. In the case of the trunks for adult, the extensions 131A, 132A are preferably dimensioned to be 20~80 mm longitudinally and 60~150 mm transversely of the first and second sheets 106, 107.

While it will be apparent from FIG. 4 that two sets of left- and right-half middle bodies 6, 7 are obtained by dividing a pair of through-holes 108, 108 placed one upon another along the line P—P, FIG. 3 shows only one of these two sets. Referring again to FIG. 4, extensions 131B, 132B opposed to the extensions 131A, 131B, respectively, are used to obtain the remaining one of the two sets.

Figure 5:
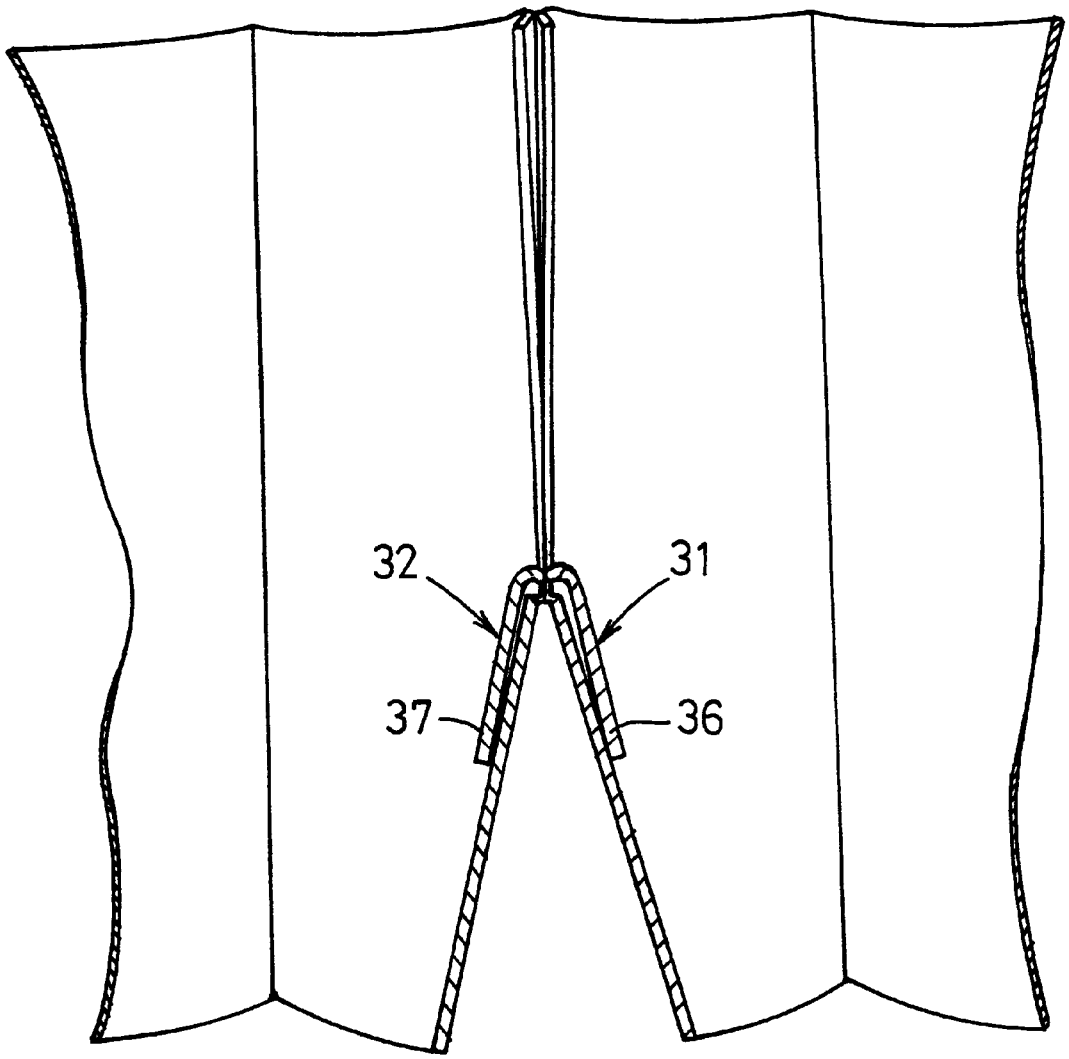
FIG. 5 is a view similar to FIG. 2 showing another embodiment of this invention.

FIG. 5 is a view similar to FIG. 2 showing another embodiment of this invention. According to this embodiment of the trunks 1, the lapels-like portions 31, 32 are merely folded back at the proximal ends thereof and do not describe the annular cross-sections as seen in FIG. 2. This embodiment differs from the embodiment previously described in reference with FIG. 2 also in that the lapels-like portions 31, 32 are bonded to the left- and right-half middle bodies 6, 7 neither at their lower ends 36, 37 nor elsewhere.

To realize this invention, various stock materials such as a nonwoven fabric, a woven fabric and a plastic film may be used to form the respective bodies 2, 3, 6, 7. These stock materials may be bonded one to another by use of appropriate adhesives such as hot melt adhesive, or heat- or ultrasonic sealing technique. This invention allows the trunks 1 to be made by a relatively simple method at a cost sufficiently low to consume the trunks 1 as disposable article. The trunks 1 according to this invention can be used as various disposable garments such as shorts for incontinent patients or training pants for babies.

The disposable trunks-type garments according to this invention includes the crotch regions in which a pair of sheets are put flat and bonded together along the sealing line. However, the pair of lapels-like portions provided in the crotch regions function to alleviate a stimulation from which the wearer's skin would otherwise suffer due to the portions of the sheets put flat and bonded together.

What is claimed is:

1. A trunks-type garment having a front body portion, a rear body portion and a crotch region, which trunks-type garment comprises:

a pair of sheets having U-shaped cutouts which are identical to each other in shape as well as in size, said pair of sheets being positioned flat together so as to align said U-shaped cutouts with each other, said U-shaped cutouts having peripheral portions that are positioned flat and are bonded together to form a transition from the front body to the rear body in the crotch region, said pair of sheets having extensions which extend outward from edges of said U-shape cutouts at bottoms thereof, which extensions are folded back onto inner surfaces of said pair of sheets.

2. The garment according to claim 1, wherein said extensions are folded back so as to describe annular curves in a vicinity of proximal ends thereof and are bonded to the inner surfaces of said pair of sheets.

3. The garment according to claim 1, wherein said pair of sheets are made of a nonwoven fabric containing thermoplastic synthetic fibers and are bonded to each other along edges of said U-shaped cutouts.

4. The garment according to claim 2, wherein said pair of sheets are made of a nonwoven fabric containing thermoplastic synthetic fibers and are bonded to each other along edges of said U-shaped cutouts.

5. The garment according to claim 3, wherein the pair of sheets are bonded to each other along edges of said U-shaped cutouts by means of one of a hot melt adhesive and a sealing technique.

6. The garment according to claim 4, wherein the pair of sheets are bonded to each other along edges of said U-shaped cutouts by means of one of a hot melt adhesive and a sealing technique.

* * * * *

UNITED STATES PATENT AND TRADEMARK OFFICE

CERTIFICATE OF CORRECTION

PATENT NO. : 6,308,339 B1
DATED : October 30, 2001
INVENTOR(S) : Masaki Murakami et al.

It is certified that error appears in the above-identified patent and that said Letters Patent is hereby corrected as shown below:

Title page,
Please change the PCT Number to read -- PCT/JP99/06887 --

Signed and Sealed this

Fourth Day of June, 2002

*Attest:*

*Attesting Officer*

JAMES E. ROGAN
*Director of the United States Patent and Trademark Office*